US012285064B2

(12) United States Patent
Vysotska et al.

(10) Patent No.: US 12,285,064 B2
(45) Date of Patent: Apr. 29, 2025

(54) POCKET FOR A GARMENT

(71) Applicant: LULULEMON ATHLETICA CANADA INC., Vancouver (CA)

(72) Inventors: Olga Vysotska, Vancouver (CA); Willem Jacob Deurloo, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 19 days.

(21) Appl. No.: 17/377,376

(22) Filed: Jul. 16, 2021

(65) Prior Publication Data

US 2022/0015482 A1 Jan. 20, 2022

Related U.S. Application Data

(60) Provisional application No. 63/054,066, filed on Jul. 20, 2020.

(51) Int. Cl.
*A41D 27/20* (2006.01)

(52) U.S. Cl.
CPC ..... *A41D 27/201* (2013.01); *A41D 27/205* (2013.01)

(58) Field of Classification Search
CPC .... A41D 27/201; A41D 27/205; A41D 27/20; A41D 27/02; A41D 7/204
See application file for complete search history.

(56) References Cited

U.S. PATENT DOCUMENTS 2,224,752 A * 12/1940 Tworoger ..... A41D 27/20 2/253
2,489,868 A * 11/1949 Dowling ..... A41D 27/20 D2/857
2,527,224 A * 10/1950 Landy ..... A41D 27/202 2/253
3,144,127 A * 8/1964 Fogel ..... A45C 11/04 206/5
3,320,620 A * 5/1967 Weidler ..... A63B 57/20 224/919
3,688,315 A * 9/1972 Helmur ..... A41D 27/20 2/252
4,513,455 A * 4/1985 Gerhardt ..... C07C 51/353 D2/857
5,072,456 A * 12/1991 Elin ..... A41D 13/0012 2/253
5,509,147 A * 4/1996 Busquets ..... A41D 27/202 2/253
9,066,547 B2 * 6/2015 Kim ..... A41D 27/20
9,557,139 B1 * 1/2017 Miner ..... A44B 18/0073
10,555,572 B2 * 2/2020 Diakonov ..... A41F 9/00
2003/0177567 A1 * 9/2003 Yoshimura ..... A41D 1/02 2/250
2005/0000001 A1 * 1/2005 Goldkind ..... A41D 27/20 2/227

(Continued)

*Primary Examiner* — Clinton T Ostrup
*Assistant Examiner* — Akwokwo Olabisi Redhead
(74) *Attorney, Agent, or Firm* — CONNEELY PC; Joseph Conneely

(57) ABSTRACT

Examples of a pocket for a garment are described. The pocket for a garment, such as sport apparel, comprises a first pocket bag having a first pocket opening and a second pocket bag having a second pocket opening, wherein the first and second pocket bags share a middle panel therebetween forming a dual entry pocket or double pocket.

19 Claims, 14 Drawing Sheets

(56) References Cited

U.S. PATENT DOCUMENTS

| | | | | |
|---|---|---|---|---|
| 2005/0279660 | A1 | 12/2005 | Deflin et al. | |
| 2009/0300818 | A1* | 12/2009 | Waite | A63B 47/001 2/76 |
| 2012/0090076 | A1 | 4/2012 | Kenney et al. | |
| 2013/0091619 | A1* | 4/2013 | Hacker | A41D 1/08 2/228 |
| 2014/0026288 | A1* | 1/2014 | Passman | A41D 13/0012 2/102 |
| 2014/0143936 | A1* | 5/2014 | Flanagan | A63B 57/20 2/247 |
| 2015/0157074 | A1* | 6/2015 | Trapani | A41D 27/201 2/251 |
| 2016/0183614 | A1* | 6/2016 | Kuipers | A41D 27/201 2/253 |
| 2020/0323286 | A1* | 10/2020 | Levien | A45C 15/00 |
| 2021/0235792 | A1* | 8/2021 | Rea | A41D 27/201 |
| 2021/0289864 | A1* | 9/2021 | Obletz | A41D 13/0012 |

* cited by examiner

POCKET FOR A GARMENT

This application claims priority from and the benefit of the filing date of U.S. Provisional Patent Application No. 63/054,066, filed Jul. 20, 2020, and the entire content of such application is incorporated herein by reference.

FIELD

This application relates to the field of sports apparel, and more specifically, to a dual entry or double pocket for a garment such as a skirt or a pair of shorts or pants.

BACKGROUND

Consumers are demanding high performance activewear and sportswear. Currently, many such garments do not fit well around a wearer's legs, require frequent adjustment, and have pockets that often do not adequately secure personal items and sporting equipment when the wearer is engaged in stretching, exercising, and athletic performance. Typically, sportswear should be snug but also needs to provide adequate room for holding items such as smart phones, keys, tennis balls, etc. At the same time, such garments should remain flexible to keep wearers comfortable during stretching, exercising, and other athletic performance.

SUMMARY OF THE APPLICATION

In one aspect, a pocket for a garment, such as sport apparel, is provided. The pocket comprises a first pocket bag having a first pocket opening and a second pocket bag having a second pocket opening, wherein the first and second pocket bags share a middle panel therebetween forming a dual entry pocket or double pocket.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

Figure 1:
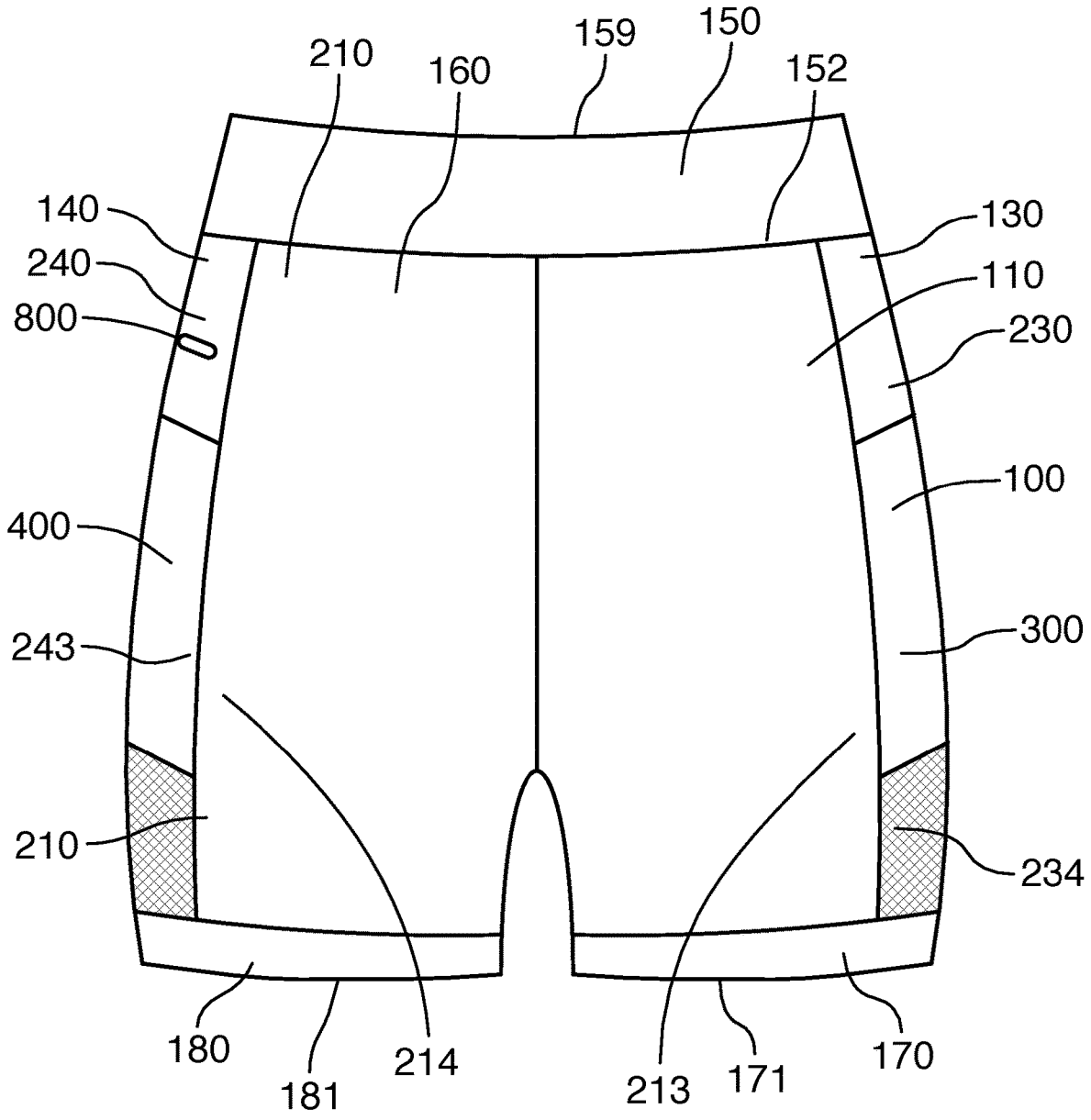
FIG. 1 is a front view illustrating an example garment having pockets formed on or in respective side panels thereof.
Figure 2:
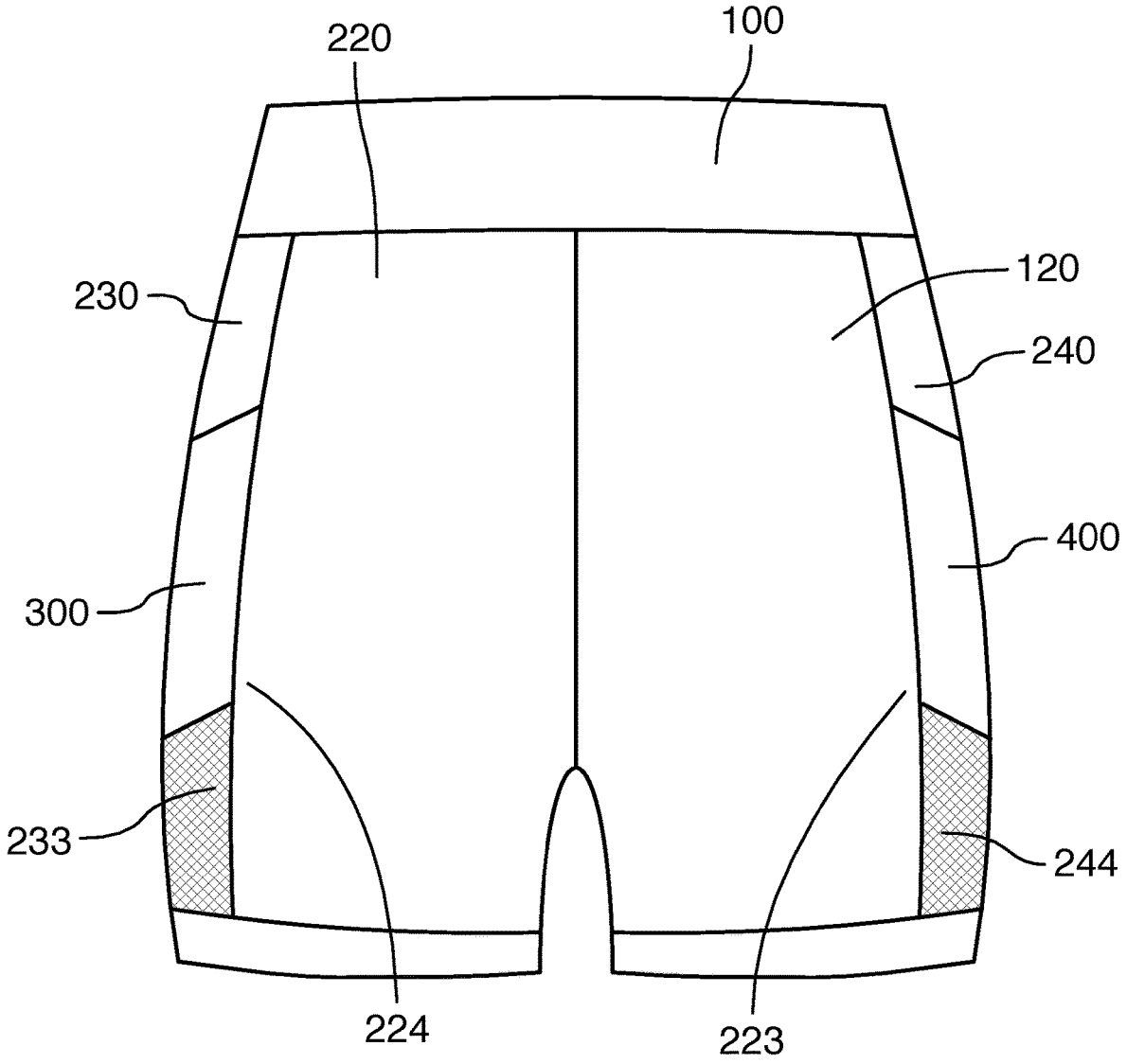
FIG. 2 is a rear view thereof.
Figure 3:
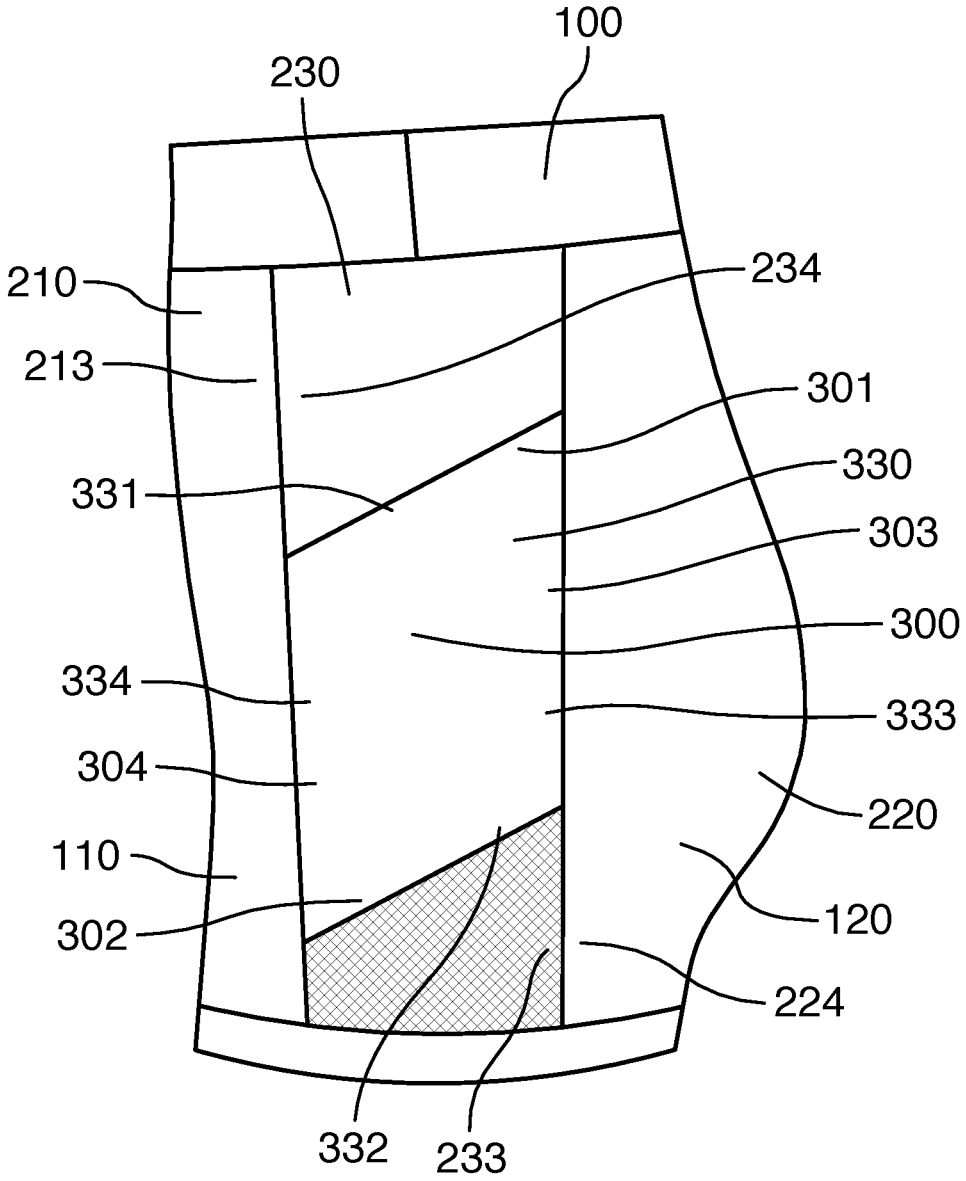
FIG. 3 is a right side view thereof, the left side view being substantially a mirror image thereof.

FIG. 1 is a front view illustrating an example garment 100 having pockets 300, 400 formed on or in respective side panels 230, 240 thereof. FIG. 2 is a rear view thereof. And, FIG. 3 is a right side view thereof, the left side view being substantially a mirror image thereof. As shown in FIGS. 1-3, the garment (or lower body garment) 100 has a front side 110, back side 120, right side 130, and left side 140. A waistband 150 having a top edge 151 extends around a waist opening 159 and is attached (e.g., connected, sewn, glued, bonded, coupled, joined, etc.) along a bottom edge 152 of the waistband 150 to a body (or pelvic) portion 160 which includes first and second (or right and left) legs (or leg portions) 170, 180 having respective leg opening 171, 181. The body portion 160 has a front panel (or fabric panel) 210 for covering a front portion of the wearer's body, a back panel (or fabric panel) 220 for covering a back portion of the wearer's body, a right side panel (or fabric panel) 230 for covering a ride side portion of the wearer's body, and a left side panel (or fabric panel) 240 for covering a left side portion of the wearer's body.

The front panel 210 has a first (or right) side 213 and a second (or left) side 214. The back panel 220 has a first (or right) side 223 and a second (or left) side 224. The right side panel 230 has a first (or right) side 233 and a second (or left) side 234. And, left side panel 240 has a first (or right) side 243 and a second (or left) side 244. The first and second (or right and left) sides (or side edges) 213, 214 of the front panel 210 are connected to the respective first and second sides (or side edges) 243, 234 of the left and right side panels 240, 230. And, the first and second (or right and left) sides (or side edges) 223, 224 of the back panel 220 are connected to the respective second and first sides (or side edges) 244, 233 of the left and right side panels 240, 230.

Figure 4:
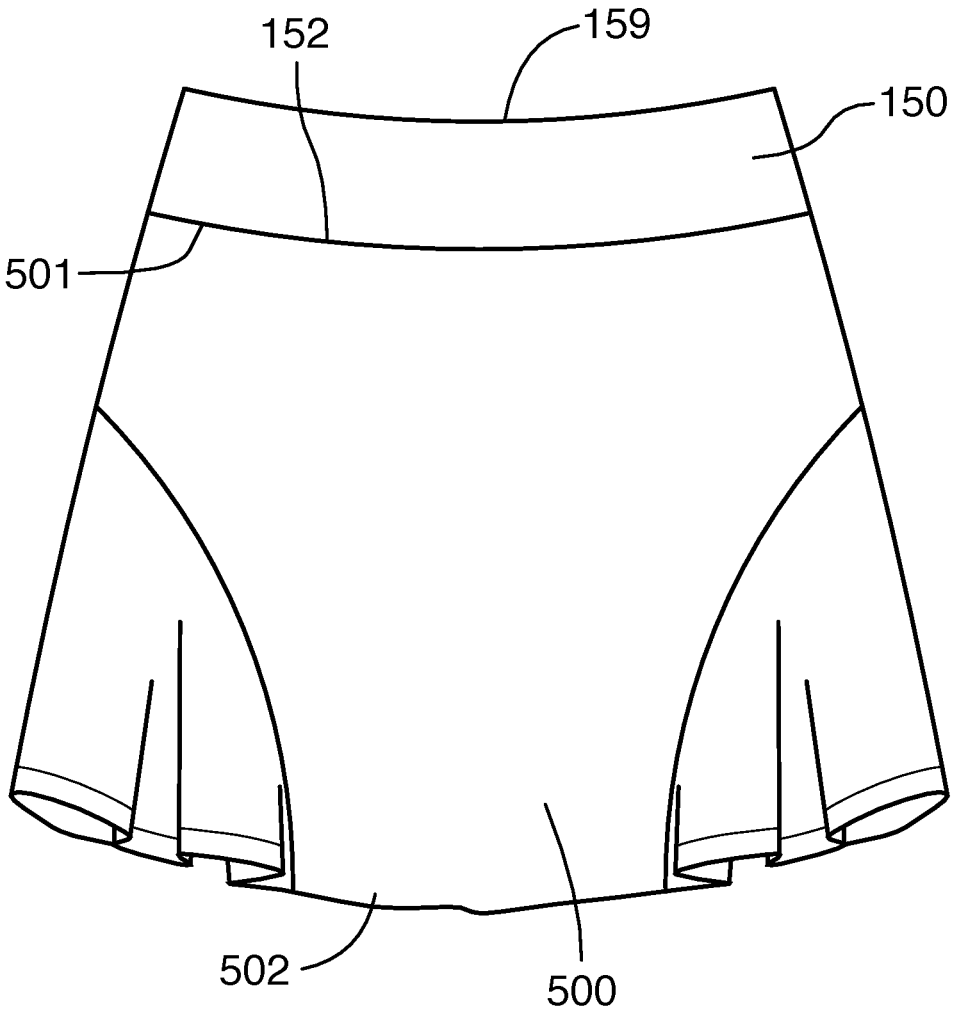
FIG. 4 is a front view illustrating an example outer layer for the garment of FIG. 1.
Figure 5:
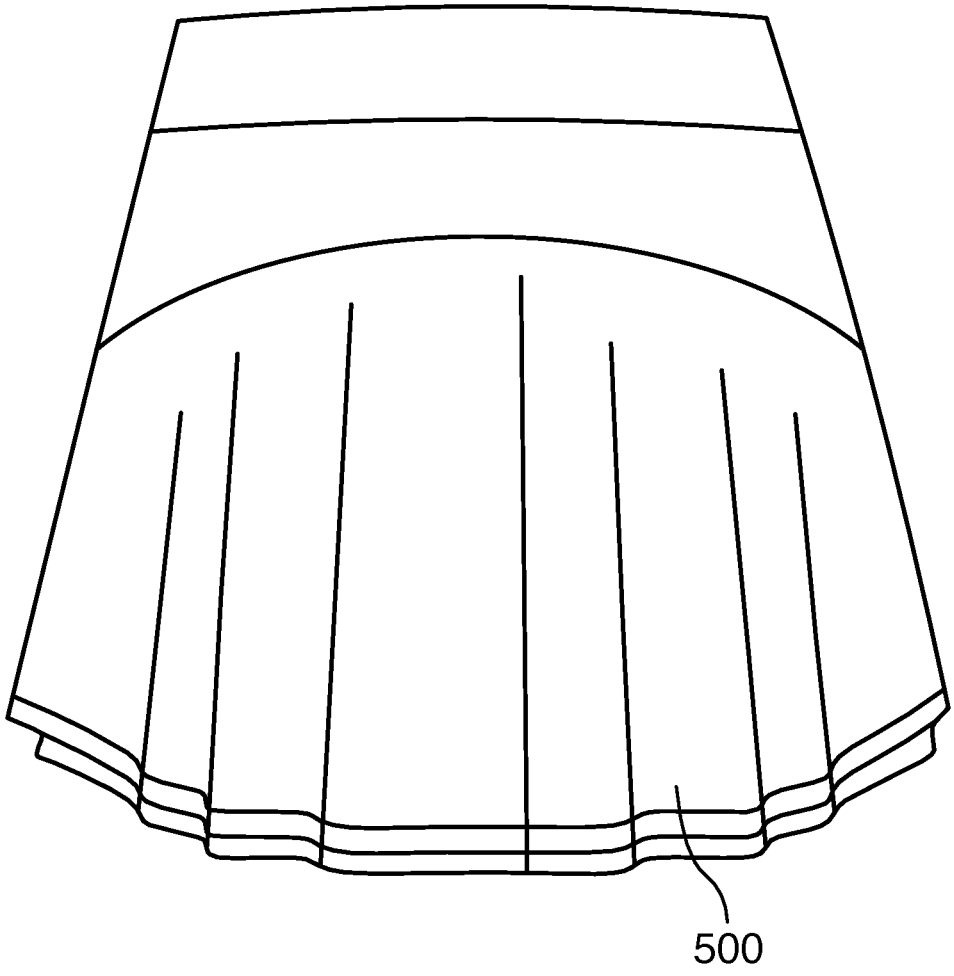
FIG. 5 is a rear view thereof.
Figure 6:
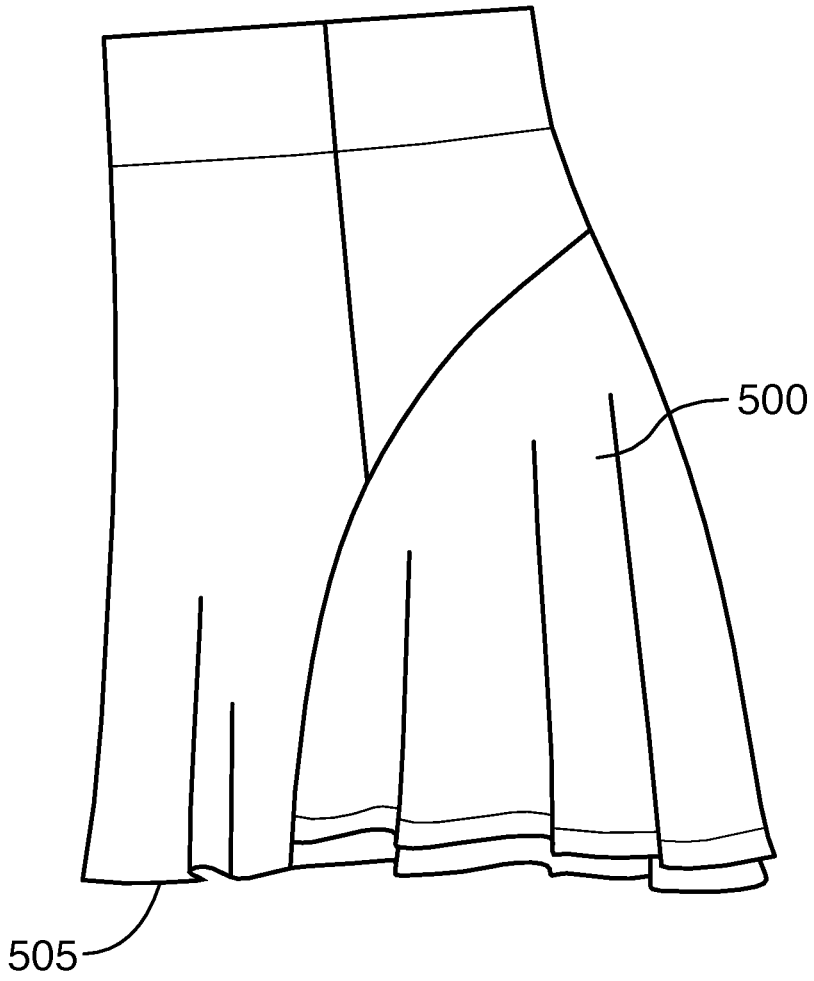
FIG. 6 is a right side view thereof, the left side view being substantially a mirror image thereof.
Figure 7:
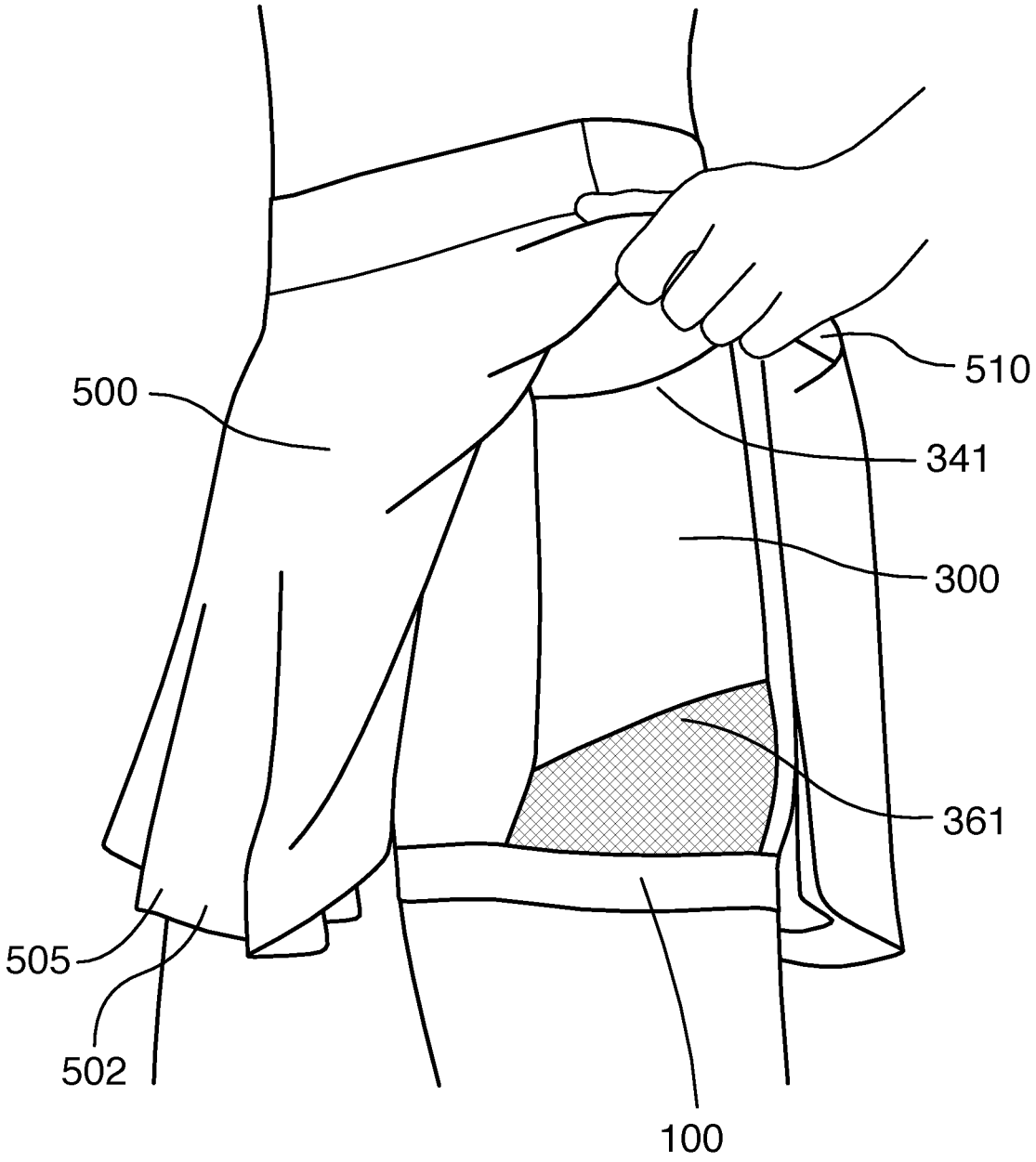
FIG. 7 is a right side perspective view illustrating the garment of FIG. 1 with its outer layer shown in a raised position to reveal the pocket positioned thereunder.

FIG. 4 is a front view illustrating an example outer layer 500 for the garment 100 of FIG. 1. FIG. 5 is a rear view thereof. FIG. 6 is a right side view thereof, the left side view being substantially a mirror image thereof. And, FIG. 7 is a right side perspective view illustrating the garment 100 of FIG. 1 with its outer layer 500 shown in a raised position 510 to reveal a pocket (e.g., 300) positioned thereunder. As shown in FIGS. 4-7, the garment 100 may include an outer layer (or skirt or skirt portion) 500 attached to the waistband 150 of the garment 100. For example, the upper edge 501 of the outer layer 500 may be attached along the bottom edge 152 of the waistband 150 of the garment 100. A portion of the lower edge 502 of the outer layer 500 may be lifted (or moved) from a lowered position 505 to a raised position 510 by a wearer to access the pockets 300, 400 formed on the side panels 230, 240 of the garment 100 as shown in FIG. 7.

The garment 100 may be a pair of shorts, pants, or the like, and with the outer layer 500 attached a skirt, skort, or the like.

Figure 8:
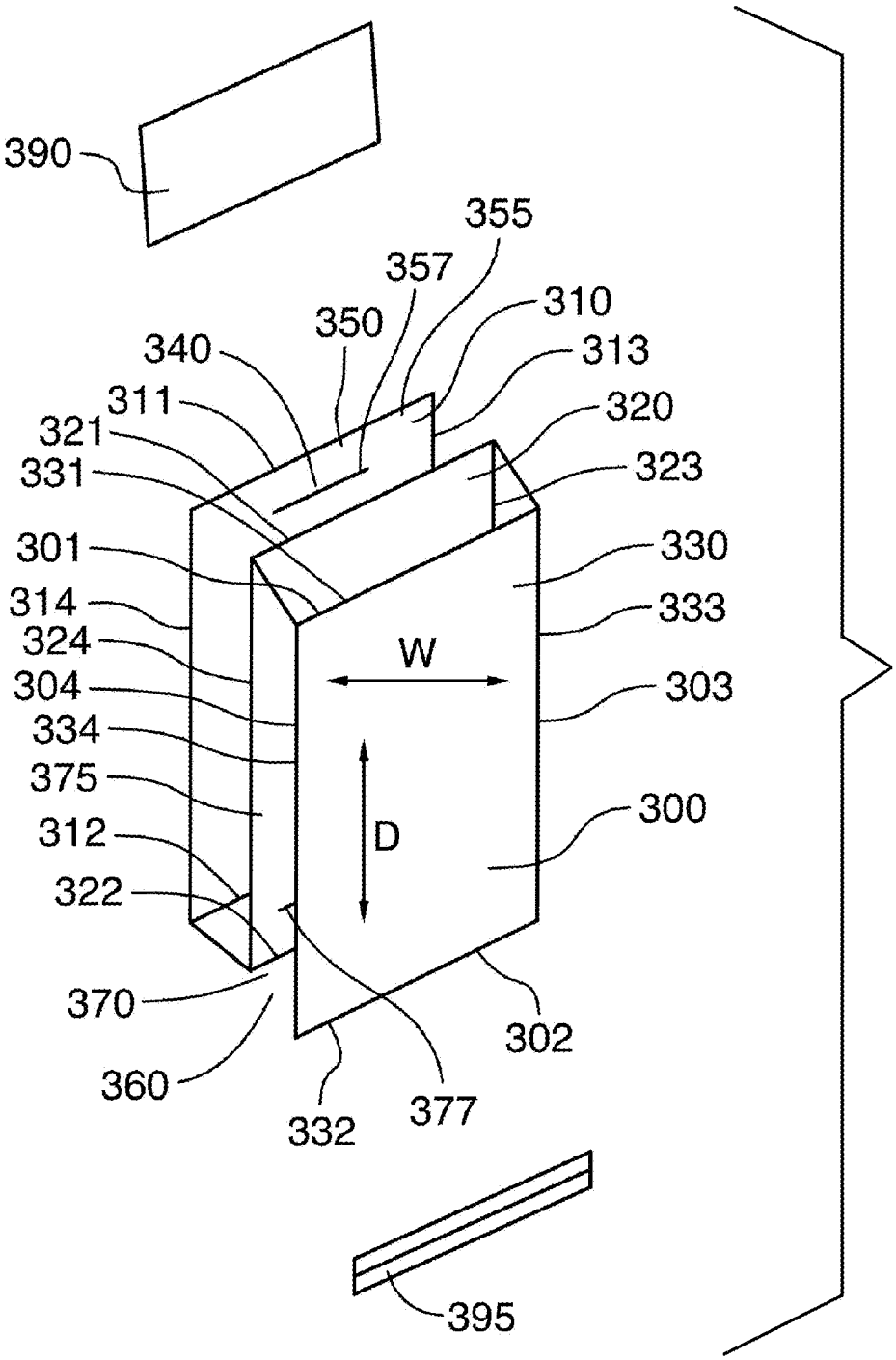
FIG. 8 is an exploded right side detail view illustrating the right side pocket of the garment of FIG. 1, the pocket having an upward facing pocket bag and a downward facing pocket bag.
Figure 9:
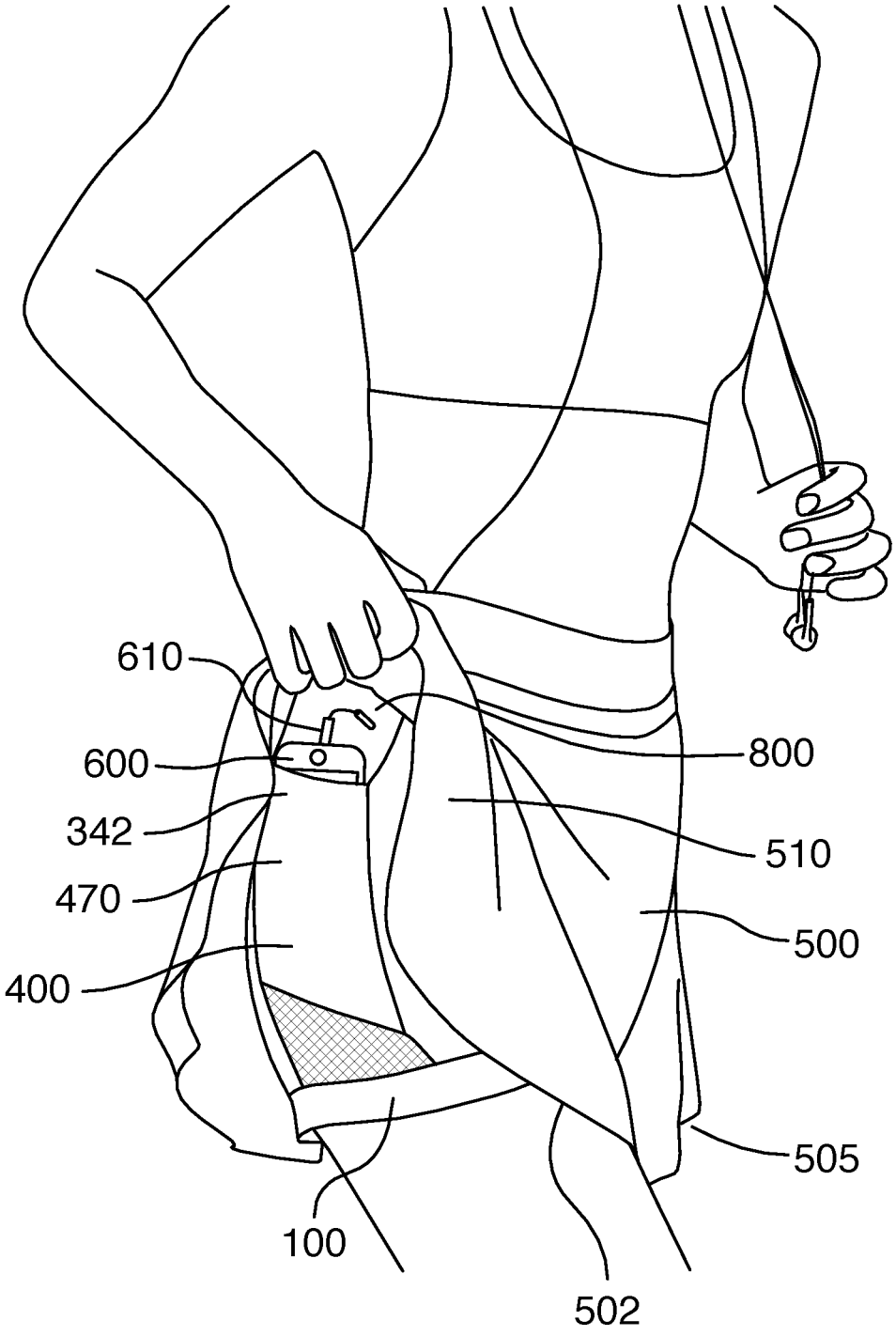
FIG. 9 is a left side perspective view illustrating the garment of FIG. 1 with its outer layer shown in a raised position and with a smart phone partially inserted into the left side upward facing pocket bag thereof.
Figure 10:
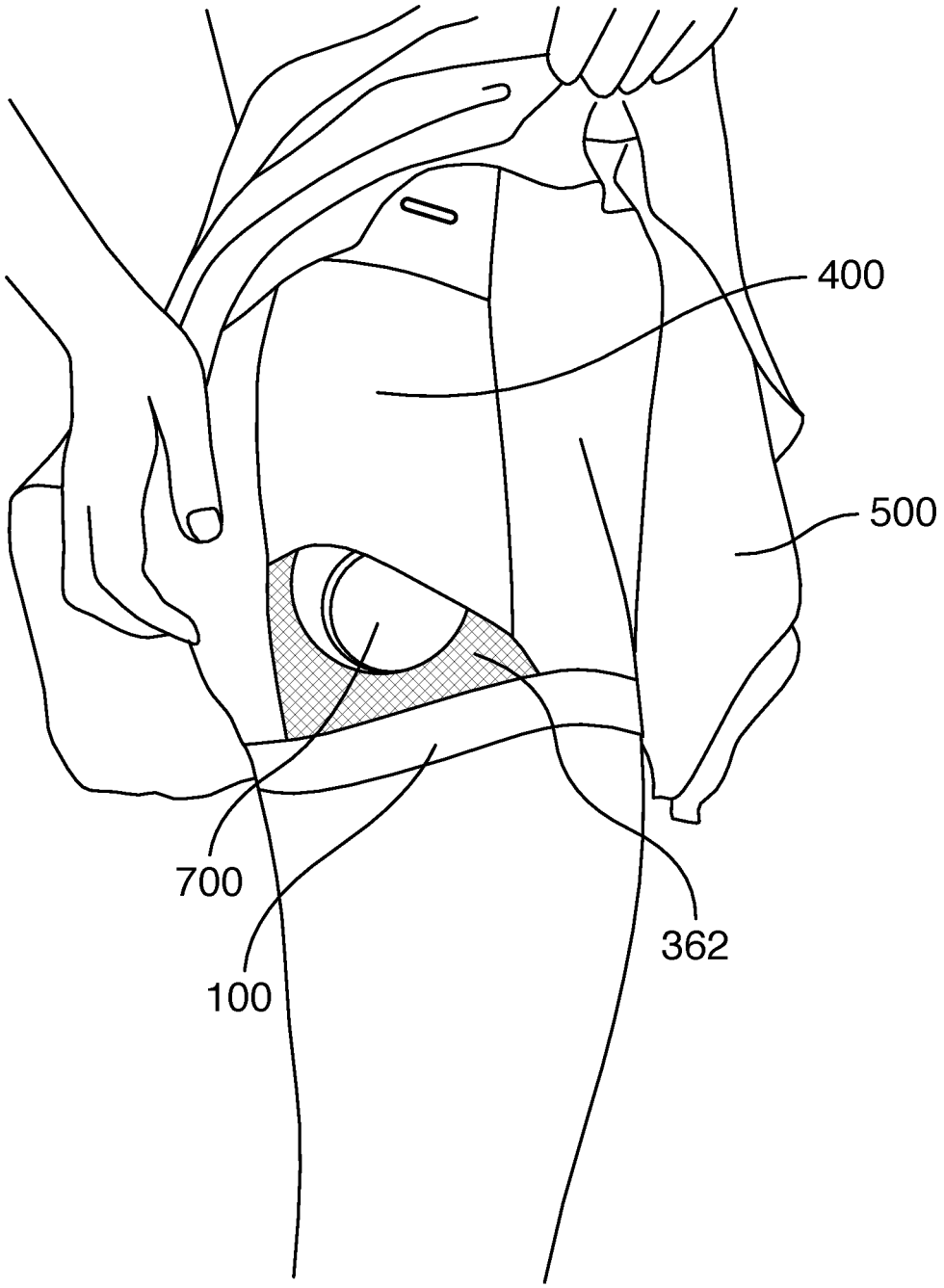
FIG. 10 is a left side view illustrating the garment of FIG. 1 with its outer layer shown in a raised position and with a tennis ball partially inserted into the left side downward facing pocket bag thereof.

FIG. 8 is an exploded right side detail view illustrating the right side pocket 300 of the garment 100 of FIG. 1, the pocket 300 having an upward facing (or first) pocket bag 350 and a downward facing (or second) pocket bag 370. FIG. 9 is a left side perspective view illustrating the garment 100 of FIG. 1 with its outer layer 500 shown in a raised position 510 and with a smart phone 600 partially inserted into the left side upward facing pocket bag 450 thereof. And, FIG. 10 is a left side view illustrating the garment 100 of FIG. 1 with its outer layer 500 shown in a raised position 510 and with a tennis ball 700 partially inserted into the left side downward facing pocket bag 470 thereof.

In one example embodiment, pockets (or dual entry or double pockets) 300, 400 are formed on or in respective side panels 230, 240 of the garment 100. One pocket 300 is shown in FIG. 8. The pocket 300 may include: an inner pocket panel (or fabric panel or first panel) 310 having a top edge 311, a bottom edge 312, a first or right side edge 313, and a second or left side edge 314; a middle pocket panel (or fabric panel or middle panel) 320 having a top edge 321, a bottom edge 322, a first or right side edge 323, and a second or left side edge 324; and, an outer pocket panel (or fabric panel or second panel) 330 having a top edge 331, a bottom edge 332, a first or right side edge 333, and a second or left side edge 334. The top edges 311, 321, 331, bottom edges 312, 322, 332, right (or first) side edges 313, 323, 333, and left (or second) side edges 314, 324, 334 of the inner, middle, and outer panels 310, 320, 330 may form the top, bottom, right (or first), and left (or second) edges 301, 302, 303, 304 of the pocket 300.

The inner pocket (or first) panel 310 is attached to the middle pocket (or middle) panel 320 along respective bottom edges 312, 322, right (or first) side edges 313, 323, and left of (or second) side edges 314, 324. At least a portion of the respective top edges 311, 321 of the inner and middle pocket panels 310, 320 are not attached thus forming a top opening (or first pocket opening) 340 for the pocket 300. The inner pocket panel 310 and the middle pocket panel 320 thus form an upward facing pocket bag (or first pocket bag or assembly or structure) 350 for the pocket 300. The attachment of the bottom edges 312, 322 of the inner pocket panel 310 and the middle pocket panel 320 forms a closed bottom end of the upward facing pocket bag 350.

The middle pocket (or middle) panel 320 is attached to the outer pocket (or second) panel 330 along respective top edges 321, 331, right (or first) side edges 323, 333, and left of (or second) side edges 324, 334. At least a portion of the respective bottom edges 322, 332 of the middle and outer pocket panels 320, 330 are not attached thus forming a bottom opening (or second pocket opening) 360 for the pocket 300. The middle pocket panel 320 and the outer pocket panel 330 thus form a downward facing pocket bag (or second pocket bag or assembly or structure) 370 for the pocket 300. The attachment of the top edges 321, 331 of the middle pocket panel 320 and the outer pocket panel 330 forms a closed top end of the downward facing pocket bag 370. As described herein, the first pocket bag 350 is inward facing (i.e., closer to the wearer's skin), while the second pocket bag 370 is outward facing (i.e., further away from the wearer's skin). However, this is for illustration purposes only and persons skilled in the art would understand that the upward (first) pocket bag 350 can be outward facing and the downward (second) pocket bag 370 can be inward facing.

In one embodiment, the bottom pocket opening (or second pocket opening) 360 may be spaced from the top pocket opening (or first pocket opening) 340 by at least a portion of the depth D of at least one of the upward facing (or first) pocket bag 350 and the downward facing (or second) pocket bag 370. In addition, at least a portion of the middle pocket panel 320 may form a portion of both the upward facing (or first) pocket bag 350 and the downward facing (or second) pocket bag 370. For example, the middle pocket panel 320 may be shared by both the upward facing pocket bag 350 and the downward facing pocket bag 370. As another example, the bottom end of the upward facing (or first) pocket bag 350 may be adjacent to or form the top end of the downward facing (or second) pocket bag 370.

In one embodiment, the top (or first) pocket opening 340 is a forward facing (e.g., toward the front 110 of the garment 100) and the bottom (or second) pocket opening 360 is rearward facing (i.e., toward the back 120 of the garment 100). In this embodiment, at least a portion of one pair of the respective side edges 313, 323, 314, 324 of the inner and middle pocket panels 310, 320 are not attached thus forming a forward facing opening (or first pocket opening) 340, while the respective top edges 311, 321 of the inner and middle pocket panels 310, 320 are attached or closed. Similarly, with respect to the second pocket bag 370, at least a portion of one pair of the respective side edges 323, 333, 324, 334 of the middle and outer pocket panels 320, 330 are not attached thus forming a rearward facing opening (or second pocket opening) 360, while the respective bottom edges 322, 332 of the middle and outer pocket panels 320, 330 are attached or closed. In such embodiment, the first pocket opening 340 may be spaced from the second pocket opening 360 by at least one of a width W of the first pocket bag 360 and a width W of the second pocket bag 370.

In one embodiment, a first gripping surface 357 is formed on at least a portion of an inner surface (e.g., 355) of the first pocket bag 350 and a second gripping surface 377 is formed on at least a portion of an inner surface (e.g., 375) of the second pocket bag 370. The gripping surfaces 357, 377 may be made from a silicone material.

In one embodiment, the pocket 300 includes a first closure configured to open and close the first pocket opening 340 and a second closure configured to open and close the second pocket opening 360. The first and the second closures may be zippers 395 or pocket flaps 390 that are extendable over the respective pocket openings 340, 360.

In one embodiment, the inner pocket panel 310 may be a portion of the side panel 230 of the garment 100. In another embodiment, the pocket 300 may be attached to the outer surface of the side panel 230 of the garment 100. In another embodiment, the right and left sides 313, 314, 323, 324, 333, 334 of the inner, middle, and outer pocket panels 310, 320, 330 of the pocket 300 may extend at least partially along the right and left sides 233, 234 of the side panel 230 of the garment 100 and may be attached thereto.

In one embodiment, the garment 100 may include only one pocket (e.g., 300). The pocket 300 may be located on the front 110, back 120, right side 130, or left side 140 of the garment 100. In another embodiment, the garment 100 may include two or more pockets 300, 400.

In one embodiment, at least one of the top and bottom edges 301, 302 of the pocket (i.e., the top and bottom edges 313, 314, 323, 324, 333, 334 of the inner, middle, and outer pocket panels 310, 320, 330) may be inclined upwards from front 110 to back 120 of the garment 100 (i.e., from left edge 304 to right edge 303 of the pocket 300) to facilitate the insertion of items (e.g., 600, 700) into the upward facing and downward facing pocket bags 350, 370 of the pocket 300. As such, the top opening 340 of the upward facing pocket bag 350 is forward facing (i.e., it faces toward the front 110 of the garment 100) and the bottom opening 360 of the downward facing pocket bag 370 is rearward facing (i.e., it faces toward the back 120 of the garment 100).

In one embodiment, the top opening 340 of the pocket 300 may be sized to receive the end of a smart phone 600 and hold the smart phone in a vertical (or approximately vertical) position as shown in FIG. 9. The bottom opening 360 of the pocket 300 may be sized to receive a tennis ball 700 as shown in FIG. 10. The tennis ball 700 may be another item such as a golf ball, squash ball, racket ball, etc., and the bottom opening 360 may be sized accordingly.

In one embodiment, a media port opening 800 may be provided above the pocket 400 to facilitate the routing of the headphone wires 610 of the smart phone 600 to the inside of the garment 100 as shown in FIGS. 1 and 9.

In one embodiment, at least a portion of the inner surface 355 along the top edge 321 of the middle pocket panel 320 is equipped with an elastic material, strip, or binding (e.g., Mobilon™ elastic) (e.g., 1510) to improve closure of and retention of items (e.g., 600) in the upward facing pocket bag 350 of the pocket 300. Similarly, at least a portion of the inner surface 375 along the bottom edge 332 of the outer pocket panel 330 is equipped with an elastic material or strip (e.g., flex elastic) (e.g., 1520) to improve closure of and retention of items (e.g., 700) in the downward facing pocket bag 370 of the pocket 300.

In one embodiment, the front, back, right side, and left side panels 210, 220, 230, 240 of the garment 100 may be made from or include a stretchable, elastic fabric such as Nulux™, Lycra™, Luxtreme™, Luon™, spandex, elastane, or the like. The inner and outer pocket panels 310, 330 may be made from or include a stretchable, elastic fabric such as Nulux™, Lycra™ Luxtreme™, Luon™, spandex, elastane, or the like. The middle pocket panel 320 may be made from or include a breathable, stretchable fabric such as Power Mesh™, or the like. And, the outer layer 500 may be made from or include a stretchable, elastic fabric such as UL Swift Stretch Enhance™ with Lycra™, or the like.

When the garment 100 is worn, the middle pocket panel 320 is moveable from a closed position 341 (see FIG. 7) in which the top opening 340 into the upward facing pocket bag 350 of the pocket 300 is collapsed or closed to an opened position 342 (see FIG. 9) in which the top opening 340 into the upward facing pocket bag 350 of the pocket 300 is expanded or opened by a wearer inserting an item (e.g., a smart phone 600) or finger into the pocket 300 between the upper edges 311, 321 of the inner and middle pocket panels 310, 320 and pulling or stretching the upper edge 321 of the middle pocket panel 320 away from the upper edge 311 of the inner pocket panel 310. In the opened position 342, at least a portion of the inner side of the upper edge 321 of the middle pocket panel 320 is separated from the outer side of the upper edge 311 of the inner pocket panel 310 expanding the top opening 340 through which items (e.g., 600) may be inserted into the upward facing pocket bag 350 of the pocket 300.

The middle pocket panel 320 is moveable from the opened position 342 in which the top pocket opening 340 is expanded or opened 342 to the closed position 341 in which the top pocket opening 340 is collapsed or closed 341 by a wearer removing an item (e.g., a smart phone 600) or finger from the upward facing pocket bag 350 of the pocket 300 between the upper edges 311, 321 of the inner and middle pocket panels 310, 320 and allowing the upper edge 321 of the middle pocket panel 320 to move toward and contact the upper edge 311 of the inner pocket panel 310 to close the top opening 340 into the upward facing pocket bag 350 of the pocket 300. In the closed position 341, at least a portion of the inner side of the upper edge 321 of the middle pocket panel 220 is adjacent to or in contact with the outer side of the upper edge 311 of the inner pocket panel 310 closing the top opening 340 into the upward facing pocket bag 350 of the pocket 300.

In addition, when the garment 100 is worn, the outer pocket panel 330 is moveable from a closed position 361 (see FIG. 7) in which the bottom opening 360 into the downward facing pocket bag 370 of the pocket 300 is collapsed or closed to an opened position 362 (see FIG. 10) in which the bottom opening 360 into the downward facing pocket bag 370 of the pocket 300 is expanded or opened by a wearer inserting an item (e.g., a tennis ball 700) or finger into the pocket 300 between the lower edges 322, 332 of the middle and outer pocket panels 320, 330 and pulling or stretching the lower edge 332 of the outer pocket panel 330 away from the lower edge 322 of the middle pocket panel 320. In the opened position 362, at least a portion of the inner side of the lower edge 332 of the outer pocket panel 330 is separated from the outer side of the lower edge 322 of the middle pocket panel 320 expanding the bottom opening 360 through which items (e.g., 700) may be inserted into the downward facing pocket bag 370 of the pocket 300.

The outer pocket panel 330 is moveable from the opened position 362 in which the bottom pocket opening 360 is expanded or opened 362 to the closed position 361 in which the bottom pocket opening 360 is collapsed or closed 361 by a wearer removing an item (e.g., a tennis ball 700) or finger from the downward facing pocket bag 370 of the pocket 300 between the lower edges 322, 332 of the middle and outer pocket panels 320, 330 and allowing the lower edge 332 of the outer pocket panel 330 to move toward and contact the lower edge 322 of the middle pocket panel 320 to close the bottom opening 340 into the downward facing pocket bag 370 of the pocket 300. In the closed position 361, at least a portion of the inner side of the lower edge 332 of the outer pocket panel 330 is adjacent to or in contact with the outer side of the lower edge 322 of the middle pocket panel 320 closing the bottom opening 360 into the downward facing pocket bag 370 of the pocket 300.

In operation, a wearer puts on the garment 100 by inserting his or her legs into the legs 170, 180 of the garment 100 and pulling the waistband 150 up to their waist. Lateral tension within the side panel 230 when the garment 100 is worn functions to draw or stretch the top edges 311, 321 of the inner and middle pocket panels 310, 320 together to close the top opening 340 into upward facing pocket bag 350 of the pocket 300 and maintain the upward facing pocket bag 350 of the pocket 300 in a closed position 341. Items 600, 700 may be inserted into or removed from the upward facing pocket bag 350 of the pocket 300 by the wearer inserting an item or finger into the top opening 340 and pulling the top edge 321 of the middle pocket panel 320 away from the top edge 311 of the inner pocket panel 310 to expand the top opening 340 into the upward facing pocket bag 350 of the pocket 300.

Similarly, lateral tension within the side panel 230 when the garment 100 is worn functions to draw or stretch the bottom edges 321, 331 of the middle and outer pocket panels 320, 330 together to close the bottom opening 360 into downward facing pocket bag 360 of the pocket 300 and maintain the downward facing pocket bag 360 of the pocket 300 in a closed position 361. Items 600, 700 may be inserted into or removed from the downward facing pocket bag 370 of the pocket 300 by the wearer inserting an item or finger into the bottom opening 360 and pulling the bottom edge 332 of the outer pocket panel 330 away from the bottom edge 322 of the middle pocket panel 320 to expand the bottom opening 360 into the downward facing pocket bag 370 of the pocket 300.

Advantageously, the pockets 300, 400 of the garment 100 allow a wearer to simultaneously store and access a smart phone 600 (or the like) and/or a tennis ball 700 (or the like) in and from the upward and downward facing pocket bags 350, 370 during stretching, exercising, and athletic performance.

Figure 11:
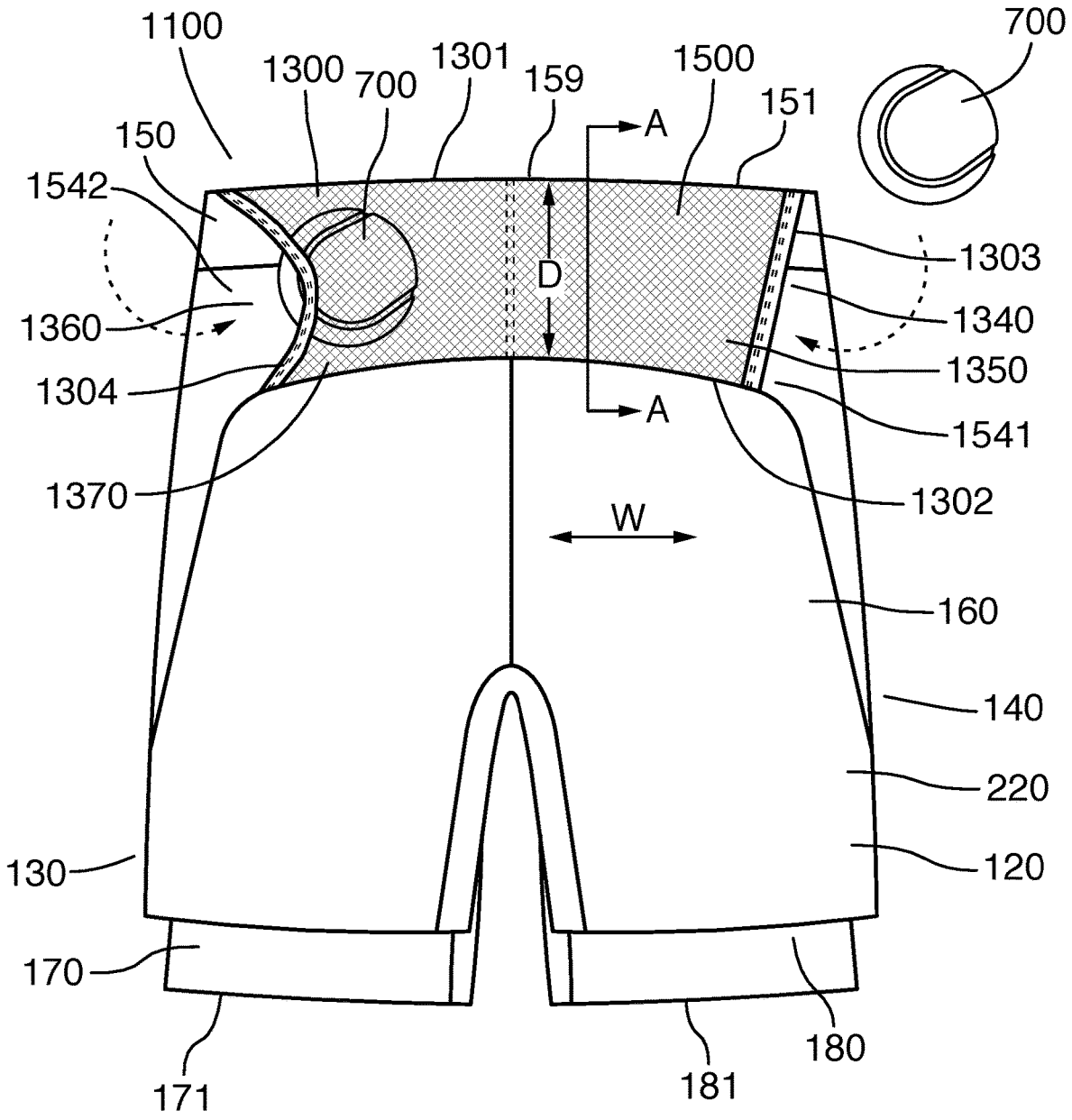
FIG. 11 is a rear view illustrating another example garment having a pocket formed on or in a back panel thereof.
Figure 12:
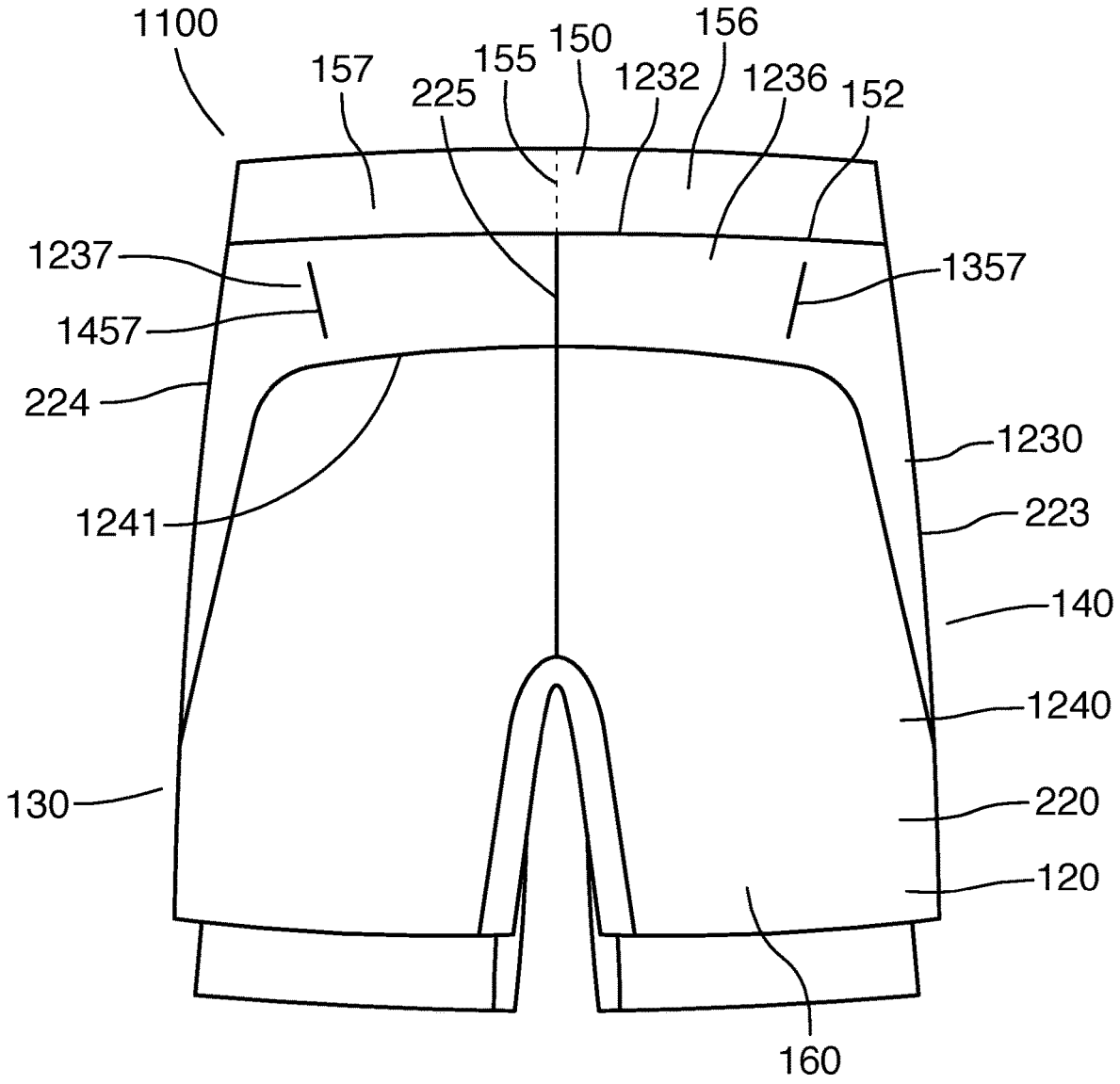
FIG. 12 is a rear view thereof with a pocket panel thereof removed.
Figure 13:
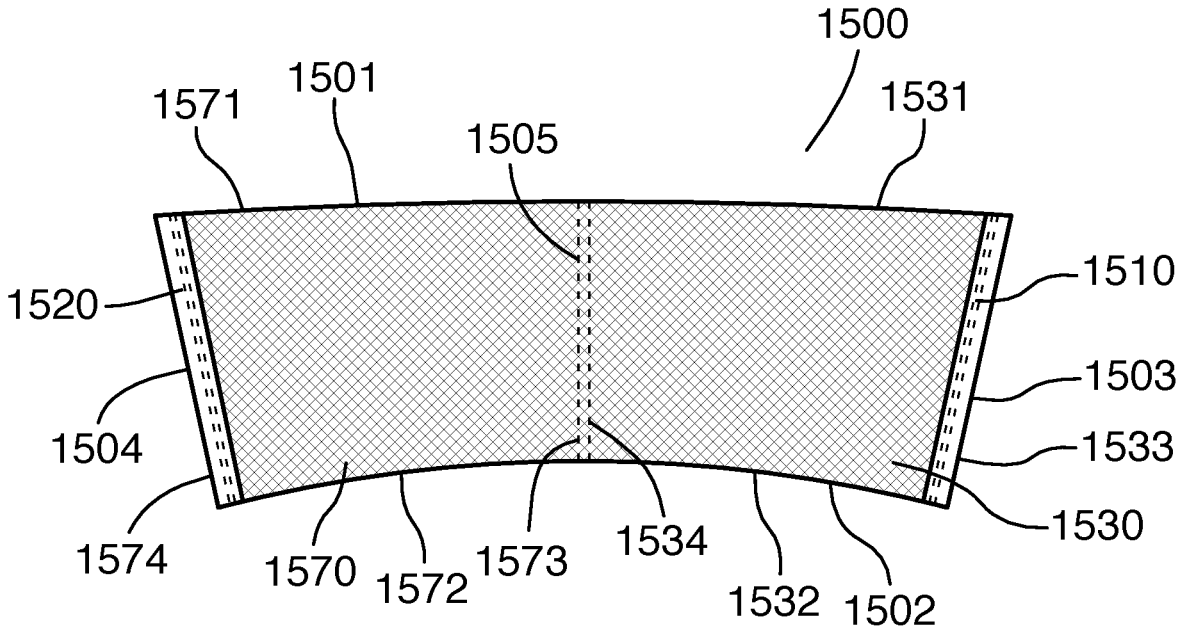
FIG. 13 is a detail view illustrating the pocket panel of the example garment of FIG. 11 in isolation.
Figure 14:
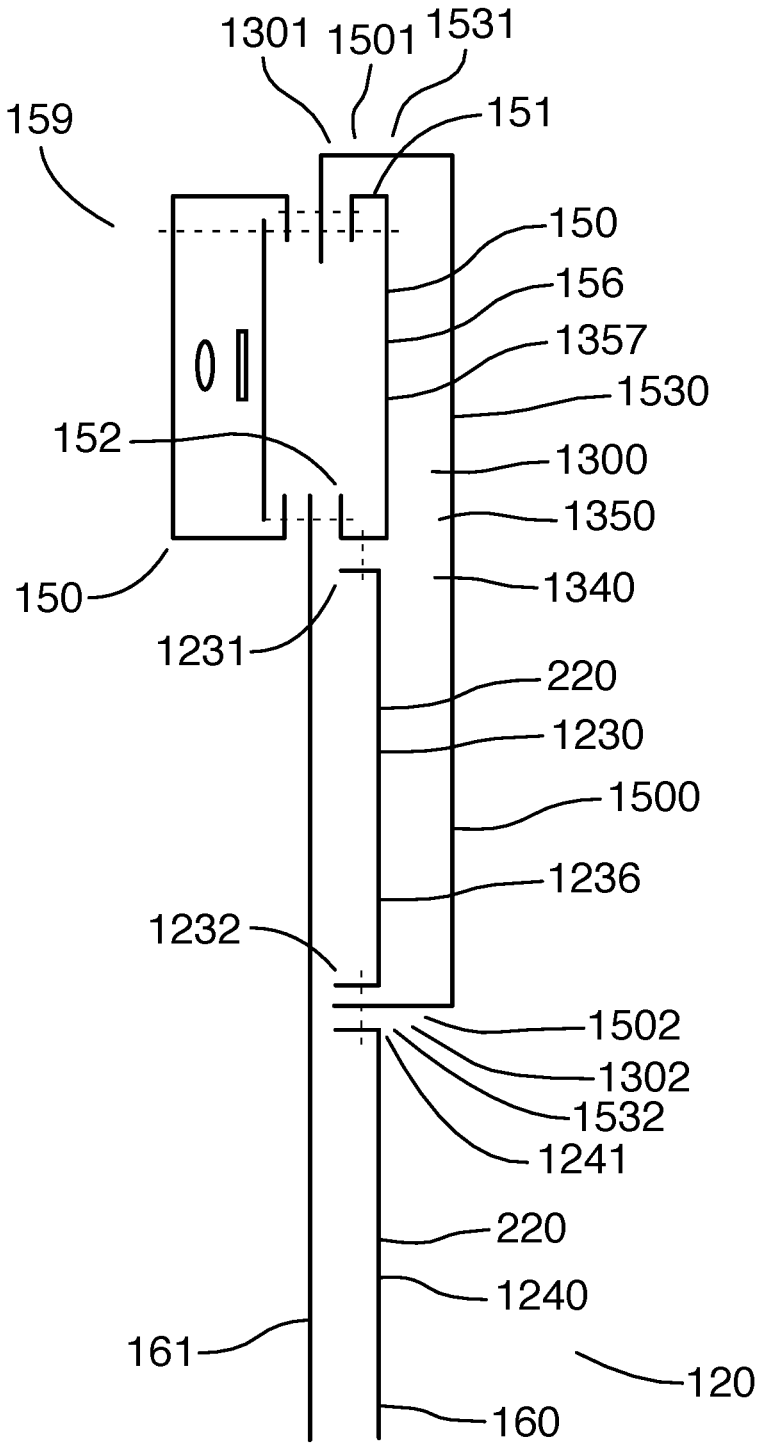
FIG. 14 is a cross sectional view taken along line A-A in FIG. 11.

FIG. 11 is a rear view illustrating another example garment 1100 having a pocket 1300 formed on or in a back panel 220 thereof. FIG. 12 is a rear view thereof with a pocket panel 1500 thereof removed. FIG. 13 is a detail view illustrating the pocket panel 1500 of the example garment 1100 of FIG. 11 in isolation. And, FIG. 14 is a cross sectional view taken along line A-A in FIG. 11.

In another example embodiment, a pocket (or dual entry or double pocket) 1300 is formed on or in the back panel 220 of the garment 1100. One pocket bag 1350 of the pocket 1300 is shown in FIG. 14. The garment 1100 may be a pair of shorts, pants, or the like.

As shown in FIGS. 11 and 12, and similar to the example embodiment of FIG. 1, the garment (or lower body garment) 1100 has a waistband 150 having a top edge 151 that extends around a waist opening 159 and is attached along a bottom edge 152 of the waistband 150 to a body (or pelvic) portion 160 which includes first and second (or right and left) legs (or leg portions) 170, 180 having respective leg opening 171, 181. The body portion 160 has a back panel (or fabric panel) 220 for covering a back portion of the wearer's body. The body portion 160 may also include a liner 161. The back panel 220 may include an upper back panel (or fabric panel) 1230 and a lower back panel (or fabric panel) 1240 which are attached along a lower edge 1232 of the upper back panel 1230 and an upper edge 1241 of the lower back panel 1240.

As shown in FIGS. 11 and 13, the garment 1100 includes a pocket panel (or fabric panel) 1500. The pocket panel 1500 has a top edge 1501, a bottom edge 1502, a first (or right) side edge 1503, and a second (or left) side edge 1504. A centre line 1505 divides the pocket panel 1500 into a first (or right) pocket panel 1530 and a second (or left) pocket panel 1570. The first and second pocket panels 1530, 1570 have respective top edges 1531, 1571, bottom edges 1532, 1572, first (or right) side edges 1533, 1573, and second (or left) side edges 1534, 1574. The top edges 1531, 1571, bottom edges 1532, 1572, first side edge 1533 of the first pocket panel 1530, and second side edge 1574 of the second pocket panel 1570 may form the top, bottom, first (or right) side, and second (or left) side edges 1501, 1502, 1503, 1504 of the pocket panel 1500.

As shown in FIGS. 10 and 14, the pocket panel 1500 is attached to the back 120 of the garment 1100 and extends over the waistband 150 to the back panel 220. In particular, the top edge 1501 of the pocket panel 1500 is attached along the top edge 151 of the waistband 150 and the bottom edge 1502 is attached along the lower edge 1232 of the upper back panel 1230 (or the upper edge 1241 of the lower back panel 1240). In addition, the pocket panel 1500 is attached along its centre line (or seam if present) 1505 to the waistband 150 of the garment 1100 along its centre line (or seam if present) 155 and to the back panel 220 along its centre line (or seam if present) 225. In embodiments where the back panel 220 does not include upper and lower back panels 1230, 1240, the bottom edge 1502 of the pocket panel 1500 may be attached to the back panel 220 below (e.g., 1232) or at the lower edge 152 of the waistband 150.

When attached to the garment 1100 as described above, the pocket panel 1500 forms first and second (or right and left) pocket bags 1350, 1370 on the back 120 of the garment 1100, each pocket bag 1350, 1370 having a respective width W and depth D.

In particular, the top edge 1531 of the first pocket panel 1530, the top edge 1571 of the second pocket panel 1570, and the top edge 151 of the waistband 150 may form the top edge 1301 of the pocket 1300; the bottom edge 1332 of the first pocket panel 1530, the bottom edge 1572 of the second pocket panel 1570, and the bottom edge 1232 of the upper back panel 1230 may form the bottom edge 1302 of the pocket 1300; the first side edge 1531 of the first pocket panel 1530 may form the first side edge 1303 of the pocket 1300; and, second side edge 1574 of the second pocket panel 1570 may form the second side edge 1304 of the pocket 1300.

At least a portion of the first side edge 1533 of the first pocket panel 1530 and the outer surfaces 156, 1236 of the waistband 150 and the upper back panel 1230 (or back panel 220) adjacent thereto are not attached thus forming a first (or right) side pocket opening (or first pocket opening) 1340 for the pocket 1300. The first pocket panel 1530 and the outer surfaces 156, 1236 of the waistband 150 and the upper back panel 1230 (or back panel 220) thus form a rightward facing pocket bag (or first pocket bag or assembly or structure) 1350 for the pocket 1300.

Similarly, at least a portion of the second side edge 1573 of the second pocket panel 1570 and the outer surfaces 157, 1237 of the waistband 150 and the upper back panel 1230 (or back panel 220) adjacent thereto are not attached thus forming a second (or left) side pocket opening (or second pocket opening) 1360 for the pocket 1300. The second pocket panel 1570 and the outer surfaces 157, 1237 of the waistband 150 and the upper back panel 1230 (or back panel 2020) thus form a leftward facing pocket bag (or second pocket bag or assembly or structure) 1370 for the pocket 1300.

In one embodiment, the first side pocket opening 1340 may be spaced from the second side pocket opening 1360 by at least a portion of the width W of at least one of the first pocket bag 1350 and the second pocket bag 1370.

In one embodiment, a first gripping surface 1357 is formed on at least a portion of an inner surface (e.g., 156, 1236) of the first pocket bag 1350 and a second gripping surface 1377 is formed on at least a portion of an inner surface (e.g., 157, 1237) of the second pocket bag 1370. The gripping surfaces 1357, 1377 may be made from a silicone material.

In one embodiment, and similar to the garment 100 of FIG. 1, the pocket 1300 includes respective first and second closures (e.g., 390, 395) configured to open and close the first and second side pocket openings 1340, 1360, respectively. The first and the second closures may be zippers 395 or pocket flaps 390 that are extendable over the pocket openings 1340, 1360.

In one embodiment, the garment 1100 may include only one pocket (e.g., 1300). The pocket 1300 may be located on the front 110, back 120, right side 130, or left side 140 of the garment 100. In another embodiment, the garment 1100 may include two or more pockets 1300. In a further embodiment, the pocket 1300 may be rotated (e.g., 90 degrees or approximately 90 degrees) hence providing a pocket 1300 having upward and downward facing pocket bags 1350, 1370 (e.g., similar to that of the garment 100 of FIG. 1).

In one embodiment, at least one of the first and second side edges 1503, 1504 of the pocket panel 1500 (i.e., the first side edge 1533 of the first pocket panel 1530 and the second side edge 1574 of the second pocket panel 1570) may be inclined upwards from the bottom edge 1502 to the top edge 1501 of the pocket panel 1500 (i.e., the bottom edges 1532, 1572 to the top edges 1531, 1571 of the first and second pocket panels 1530, 1570, respectively) to facilitate the insertion of items (e.g., 700) into the first and second pocket bags 1350, 1370 of the pocket 1300. As such, the first side opening 1340 of the first pocket bag 1350 is downward facing (i.e., it faces toward the left leg portion 180 of the garment 100). Similarly, the second side opening 1360 of the second pocket bag 1370 is downward facing (i.e., it faces toward the right leg portion 170 of the garment 100).

In one embodiment, the first and second side openings 1340, 1360 of the first and second pocket bags 1350, 1370 may be sized to receive a tennis ball 700 as shown in FIG. 11. The tennis ball 700 may be another item such as a golf ball, squash ball, racket ball, etc., and the side openings 1340, 1360 may be sized accordingly. The side openings 1340, 1360 of the first and second pocket bags 1350, 1370 may also be sized to receive the end of a smart phone 600 and hold the smart phone in a horizontal (or approximately horizontal) position.

In one embodiment, at least a portion of the right and left side edges 1503, 1504 of the pocket panel 1500 (i.e., the right side edge 1533 of the first pocket panel 1530 and the left side edge 1574 of the second pocket panel 1570) are equipped with an elastic material, strip, or binding (e.g., Mobilon™ elastic) 1510, 1520 to improve closure of and retention of items (e.g., 700) in the first and second pocket bags 1350, 1370 of the pocket 1300.

In one embodiment, the pocket panel 1500 may be made from a mesh material or fabric such as Power Mesh™, or the like.

In one embodiment, the pocket panel 1500 may be two separate pocket panels 1530, 1570. That is, the first and second pocket panels 1530, 1570 are not initially attached or are separate pieces of fabric before the garment 1100 is assembled. In this embodiment, the first and second pocket panels 1530, 1570 may at least partially overlap. For example, the second side edge 1534 of the first pocket panel 1530 may overlap the first side edge 1573 of the second pocket panel 1570, or vice versa.

In another embodiment, the pocket panel 1500 is not attached to the waistband 150 and upper back panel 1230 (or back panel 220) along the centre line 1505 of the pocket panel 1500. In this embodiment, a single pocket bag is formed by the attachment of the top and bottom edges 1501, 1502 to the top edge 151 of the waistband 150 and to the bottom edge 1232 of the upper back panel 1230 (or to the back panel 220 below or at the lower edge 152 of the waistband 150), respectively.

When the garment 1100 is worn, the first pocket panel 1530 (for example) is moveable from a closed position 1541 (e.g., see the right side of FIG. 11) in which the first side opening 1340 into the first pocket bag 1350 of the pocket 1300 is collapsed or closed to an opened position 1542 (e.g., see the left side of see FIG. 11) in which the first side opening 1340 into the first pocket bag 1350 of the pocket 1300 is expanded or opened by a wearer inserting an item (e.g., a tennis ball 700) or finger into the pocket 1300 between the first side edge 1531 of the first pocket panel 1330 and the adjacent outer surfaces 156, 1236 of the waistband and/or upper back panel 1230 (or back panel 220) and pulling or stretching the first side edge 1531 of the first pocket panel 1530 away from the adjacent outer surfaces 156, 1236 of the waistband and/or upper back panel 1230 (or back panel 220). In the opened position 1542, at least a portion of the inner side of the first side edge 1531 of the first pocket panel 1530 is separated from the adjacent outer surfaces 156, 1236 of the waistband and/or upper back panel 1230 (or back panel 220) expanding the first side opening 1340 through which items (e.g., 700) may be inserted into the first pocket bag 1350 of the pocket 1300.

The first pocket panel 1530 is moveable from the opened position 1542 in which the first pocket opening 1340 is expanded or opened 1542 to the closed position 1541 in which the first pocket opening 1340 is collapsed or closed 1541 by a wearer removing an item (e.g., a tennis ball 600) or finger from the first pocket bag 1350 of the pocket 1300 between the first side edge 1533 of the first pocket panel 1530 and the adjacent outer surfaces 156, 1236 of the waistband and/or upper back panel 1230 (or back panel 220) and allowing the first side edge 1533 of the first pocket panel 1530 to move toward and contact the adjacent outer surfaces 156, 1236 of the waistband and/or upper back panel 1230 (or back panel 220) to close the first opening 1340 into the first pocket bag 1350 of the pocket 1300. In the closed position 1541, at least a portion of the inner side of the first side edge 1533 of the first pocket panel 1530 is adjacent to or in contact with the adjacent outer surfaces 156, 1236 of the waistband and/or upper back panel 1230 (or back panel 220) closing the first opening 1340 into the first pocket bag 1350 of the pocket 1300.

In operation, a wearer puts on the garment 100 by inserting his or her legs into the legs 170, 180 of the garment 100 and pulling the waistband 150 up to their waist. Longitudinal tension within the first pocket panel 1530 developed by at least the elastic material, strip, or binding 1510 when the garment 100 is worn functions to draw or stretch the first side edge 1531 of the first pocket panel 1530 and the adjacent outer surfaces 156, 1236 of the waistband and/or upper back panel 1230 (or back panel 220) together to close the first opening 1340 into first pocket bag 1350 of the pocket 1300 and maintain the first pocket bag 1350 of the pocket 1300 in a closed position 1341. Items 600, 700 may be inserted into or removed from the first pocket bag 1350 of the pocket 1300 by the wearer inserting an item or finger into the first opening 1340 and pulling the first side edge 1533 of the first pocket panel 1530 away from the adjacent outer surfaces 156, 1236 of the waistband and/or upper back panel 1230 (or back panel 220) to expand the first opening 1340 into the first pocket bag 1350 of the pocket 1300.

Advantageously, the pocket 1300 of the garment 1100 allows a wearer to simultaneously store and access a tennis ball 700 (or the like) and/or a smart phone 600 (or the like) in and from the rightward and leftward facing pocket bags 1350, 1370 during stretching, exercising, and athletic performance.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this application are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Any example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A pocket for a garment, comprising:

a first panel and a middle panel, the first panel attached to the middle panel to form a first pocket bag having a first pocket opening, the first pocket opening being upward facing and being formed by unattached top edges of the first and middle panels, wherein respective bottom edges of the first and middle panels of the first pocket bag are attached to form a closed bottom end, and wherein the first and middle panels of the first pocket bag are completely attached along respective side edges to complete the first pocket bag; and, a second panel attached to the middle panel to form a second pocket bag having a second pocket opening, the second pocket opening being downward facing and being formed by unattached bottom edges of the second and middle panels, wherein respective top edges of the middle and second panels of the second pocket bag are attached to form a closed top end, and wherein the middle and second panels of the second pocket bag are completely attached along respective side edges to complete the second pocket bag;

wherein the first and second panels are attached on either side of the middle panel; and, wherein one of the first panel and the second panel is attached to or formed on or in an outer surface of the garment.

2. The pocket according to claim 1, wherein the first pocket opening is spaced from the second pocket opening by a depth of one of the first pocket bag and the second pocket bag.

3. The pocket according to claim 1, wherein the first pocket opening is upward and forward facing and the second pocket opening is downward and rearward facing.

4. The pocket according to claim 1, further comprising a first gripping surface formed on an inner surface of the first pocket bag and a second gripping surface formed on an inner surface of the second pocket bag.

5. The pocket according to claim 4, wherein the gripping surface comprises a silicone material.

6. The pocket according to claim 1, further comprising a first closure configured to close and open the first pocket opening and a second closure configured to close and open the second pocket opening.

7. The pocket according to claim 6, wherein at least one of the first and the second closures is a zipper.

8. The pocket according to claim 6, wherein at least one of the first and the second closures is a pocket flap that is extendable over the respective pocket opening.

9. The pocket according to claim 1, wherein the garment is one or more of a pair of shorts, a pair of pants, a skirt, and a skort.

10. The pocket according to claim 1, wherein the pocket is attached to a side of the garment.

11. The pocket according to claim 1, wherein the first pocket bag is sized to receive a smart phone or the like and the second pocket bag is sized to receive a tennis ball, a squash ball, or a racket ball.

12. The pocket according to claim 1, wherein the first and middle panels of the first pocket bag are an inner pocket panel and a middle pocket panel, and wherein the middle and second panels of the second pocket bag are the middle pocket panel and an outer pocket panel.

13. The pocket according to claim 12, wherein the inner pocket panel is a portion of the garment.

14. The pocket according to claim 1, wherein the garment is a pair of shorts and further comprising an outer layer attached to a waistband of the shorts, the outer layer extending down over the pocket.

15. The pocket according to claim 14, wherein the outer layer is a skirt portion of the garment.

16. The pocket of claim 1, wherein at least one of: the first pocket bag is inward facing and the second pocket bag is outward facing; and, the first panel is attached to an inner side of the middle panel and the second panel is attached to an outer side of the middle panel.

17. The pocket of claim 1, wherein the middle panel is made from a breathable, stretchable fabric and wherein the first panel and the second panel are made from a stretchable, elastic fabric.

18. The pocket of claim 1, wherein the first panel, the middle panel, and the second panel are made from a stretchable fabric and wherein lateral tension caused by stretching of the first panel, the middle panel, and the second panel when the garment is worn maintains the first pocket opening and the second pocket opening in respective closed positions.

19. The pocket of claim 1, wherein the first panel, the middle panel, and the second panel overlap; wherein the first panel, the middle panel, and the second panel are directly attached along respective side edges; wherein the first panel, the middle panel, and the second panel are each solid panels having no openings formed therein; wherein each of the first panel, the middle panel, and the second panel are trapezoidal in shape; and, wherein the first and second pocket bags are completely separated.

* * * * *